US006866618B2

(12) United States Patent
Rusinak-Connors

(10) Patent No.: US 6,866,618 B2
(45) Date of Patent: Mar. 15, 2005

(54) OFFICE EXERCISE DEVICE

(76) Inventor: Tina Marie Rusinak-Connors, 1703 Certainty Dr., Point Pleasant, NJ (US) 08742

( * ) Notice: Subject to any disclaimer, the term of this patent is extended or adjusted under 35 U.S.C. 154(b) by 435 days.

(21) Appl. No.: 09/927,859

(22) Filed: Aug. 10, 2001

(65) Prior Publication Data

US 2002/0098960 A1 Jul. 25, 2002

Related U.S. Application Data

(60) Provisional application No. 60/224,330, filed on Aug. 11, 2000.

(51) Int. Cl.[7] ..... A63B 71/00

(52) U.S. Cl. ..... 482/148; 482/57

(58) Field of Search ..... 482/148, 57, 121–130; 128/25 R

(56) References Cited

U.S. PATENT DOCUMENTS 5,807,212 A 9/1998 Nelson
5,813,947 A 9/1998 Densmore

*Primary Examiner*—Nicholas D. Lucchesi
*Assistant Examiner*—Lori Baker Amerson

(57) ABSTRACT

The present invention relates to an exercise device generally comprising a mounting element, an exercise element mounted to the mounting element, and a retractable securing element for removably securing the device to a chair. The exercise device of the present invention may be used by a user while seated in a chair and is relatively small, light weight and easily stored.

4 Claims, 4 Drawing Sheets

OFFICE EXERCISE DEVICE

SPECIFICATION

This application claims priority to U.S. Provisional Application Ser. No. 60/224,330, filed Aug. 11, 2000.

BACKGROUND OF THE INVENTION

The present invention generally relates to office exercise devices which can be used by a user while seated at a desk, and more particularly, exercise devices which may be removably mountable to a chair.

Many people appreciate the need to exercise regularly. Unfortunately, busy business schedules often make it difficult to incorporate a regular exercise schedule into a working week. An exercise device that can be used while a person is working would provide the benefit of exercise which can be achieved during working hours.

Lower body exercise devices known in the art for use in a seated position generally are large, complicated and/or cumbersome and are not easily adaptable for use with any office furniture. For example, U.S. Pat. No. 5,813,947 (the "'947 patent") discloses an exercise apparatus which can be used while the user is working. The exercise apparatus of the '947 patent is an exercise desk which includes an exercise apparatus mounted to an enclosure which has an upper working surface. It is used in a standing position and is therefore not well suited for the work place.

U.S. Pat. No. 5,807,212 (the "'212 patent") also discloses an exercise apparatus for use while working. The apparatus of the '212 patent can be used while in a seated position in combination with a chair. It includes an anchor means attached to an exercise means, a barrier bar, a sleeve attached to the exercise means which includes a locking aperture, a stem slidably located within the sleeve and to which the barrier bar is attached and a channel member which has receptacles for receiving the legs of a chair and which connects to the locking means. The apparatus of the '212 patent is rather large. In addition, due to the design of the channel member which has receptacles for receiving the legs of a chair, the exercise apparatus of the '212 patent is not easily adapted for use with any type of desk chair. For example, an office chair with five wheels cannot be used with the exercise device of the '212 patent. Furthermore, due to its size, the exercise apparatus of the '212 patent is not easily stored.

The present invention addresses the inadequacies of the prior art by providing a simplified exercise device for use while seated in a chair. The exercise device of the present invention is small, light weight and easily secured to any chair. In addition, due to its relatively small size and light weight the exercise device of present invention is easily stored.

SUMMARY OF THE INVENTION

The present invention is directed to an exercise device for use while seated in a chair at a desk or other working surface. The device of the present invention can be used with virtually any type of chair. Generally, the device includes a mounting element, an exercise element mounted to the mounting element, and a retractable securing element for removably securing the device to a chair. The exercise element is preferably a pedal element having two pedals, similar to the pedals of a bike, which may be mounted to the mounting element with an attachment element. Alternatively, the exercise element is a stepping element having two steps similar to those used on a stair master. The exercise device may further comprise a height adjustment element and/or a resistance adjustment element operationally linked to the exercise element.

BRIEF DESCRIPTION OF THE DRAWINGS

The present invention may be better understood with reference to the attached drawings in which—

DETAILED DESCRIPTION OF THE INVENTION

Figure 1:
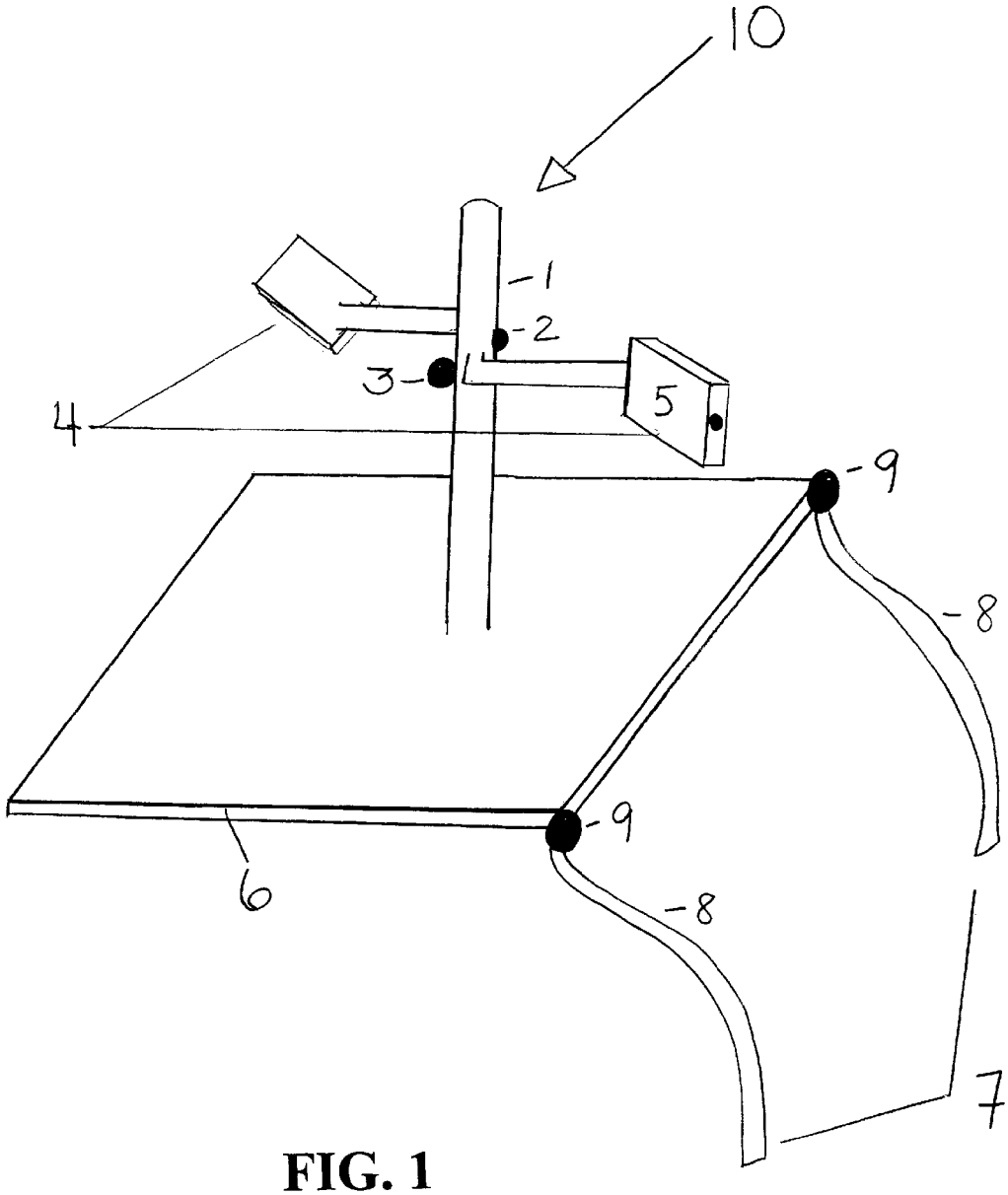
FIG. 1 is a perspective view of a first embodiment of an exercise device in accordance with the present invention.

Referring to FIGS. 1–4, the exercise device of the present invention generally includes an exercise element 4 or 11 which is mounted to a mounting element 6 which comprises a retractable securing element 7. The mounting element 6 is preferably from about 0.5 to 2.0 feet long and from about 1.0 to 3.0 feet wide. More preferably, the mounting element 6 is about 1 foot long and from about 1 to 2 feet wide. The mounting element 6 may be made from any suitable material and preferably is a piece of hard plastic or rubber. The retractable securing element 7 may be any suitable material that can secure the mounting element to any chair to ensure the exercise device of the present invention remains stationary during use. For example, the securing element may be two sturdy but flexible ropes that can be used to tie the device to any chair. Preferably, the securing element comprises two velcro straps 8 placed on either side of the mounting element 6. More preferably the securing element 7 includes a retractor element 9 into which the velcro straps 8 are retracted and which is affixed to either side of the mounting element 6.

In addition, the exercise device of the present invention includes a resistance adjustment element 3 which is operationally linked to the exercise element 4 or 11. Nonlimiting examples of resistance adjustment elements 3 known in the art include pneumatic spring cylinders, pneumatic or hydraulic cylinders or dashpots, an elasotmeric rod or tube, a spring, etc.

Figure 2:
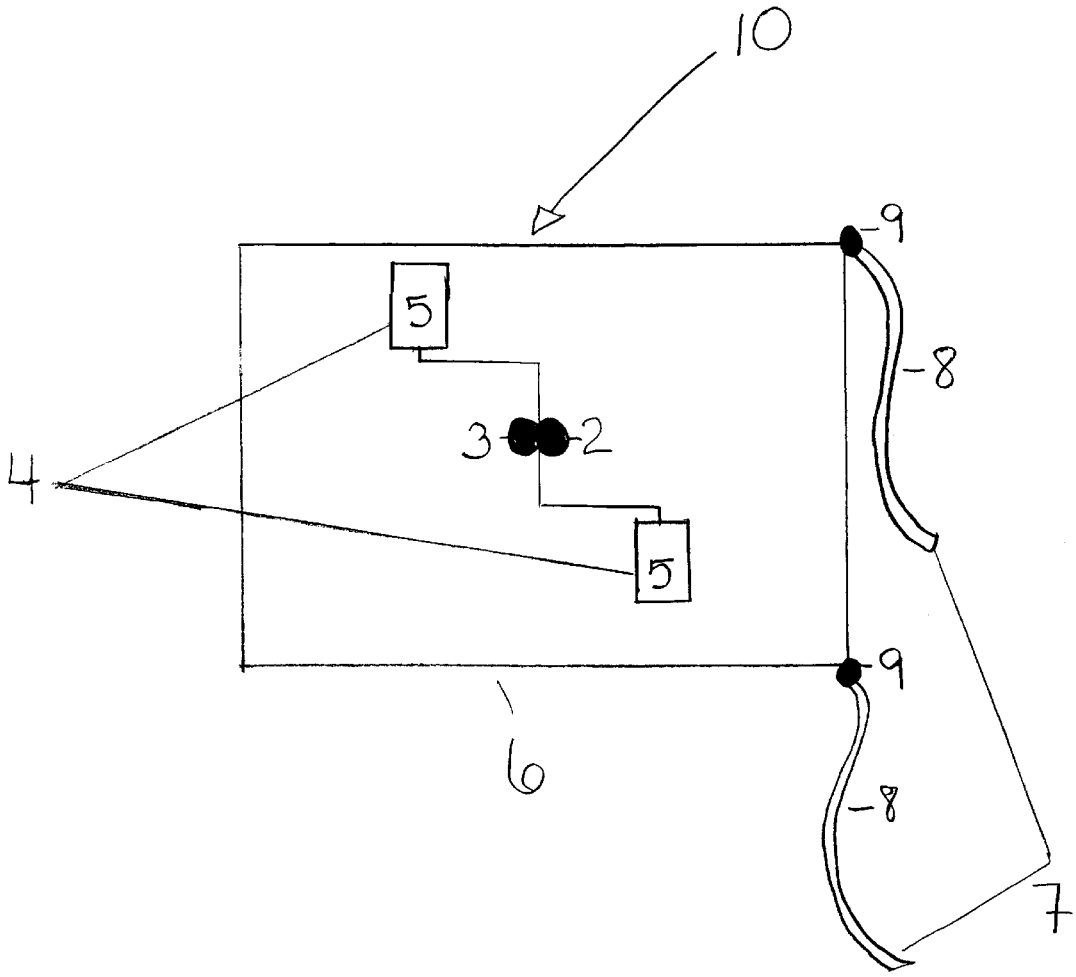
FIG. 2 is a top view of the exercise device of FIG. 1.

A first embodiment of an exercise device 10 that may be used while the user is seated at a desk or other working surface is illustrated in FIGS. 1 and 2. Referring to FIG. 1, the exercise element 4 is a pedal element having two pedals 5 similar to bicycle pedals. The exercise device of the first embodiment further comprises an attachment element 1 to which the pedal element is attached and which mounts the pedal element to the mounting element 6. Any suitable pedal element known in the art may be used in accordance with the present invention. The attachment element 1 may have a non-use position, which will allow the user to lay the attachment element flat for storage purposes, as well as a use position (i.e. an upright position). In a preferred embodiment, the pedal element is about 1 foot high. Referring to FIG. 2, the pedal element may be raised or lowered for comfort with a height adjustment element 2. The exercise element 4 is further operationally linked to the resistance adjustment element 3 which may be adjusted by the user to either increase or decrease the force required to pedal.

Figure 3:
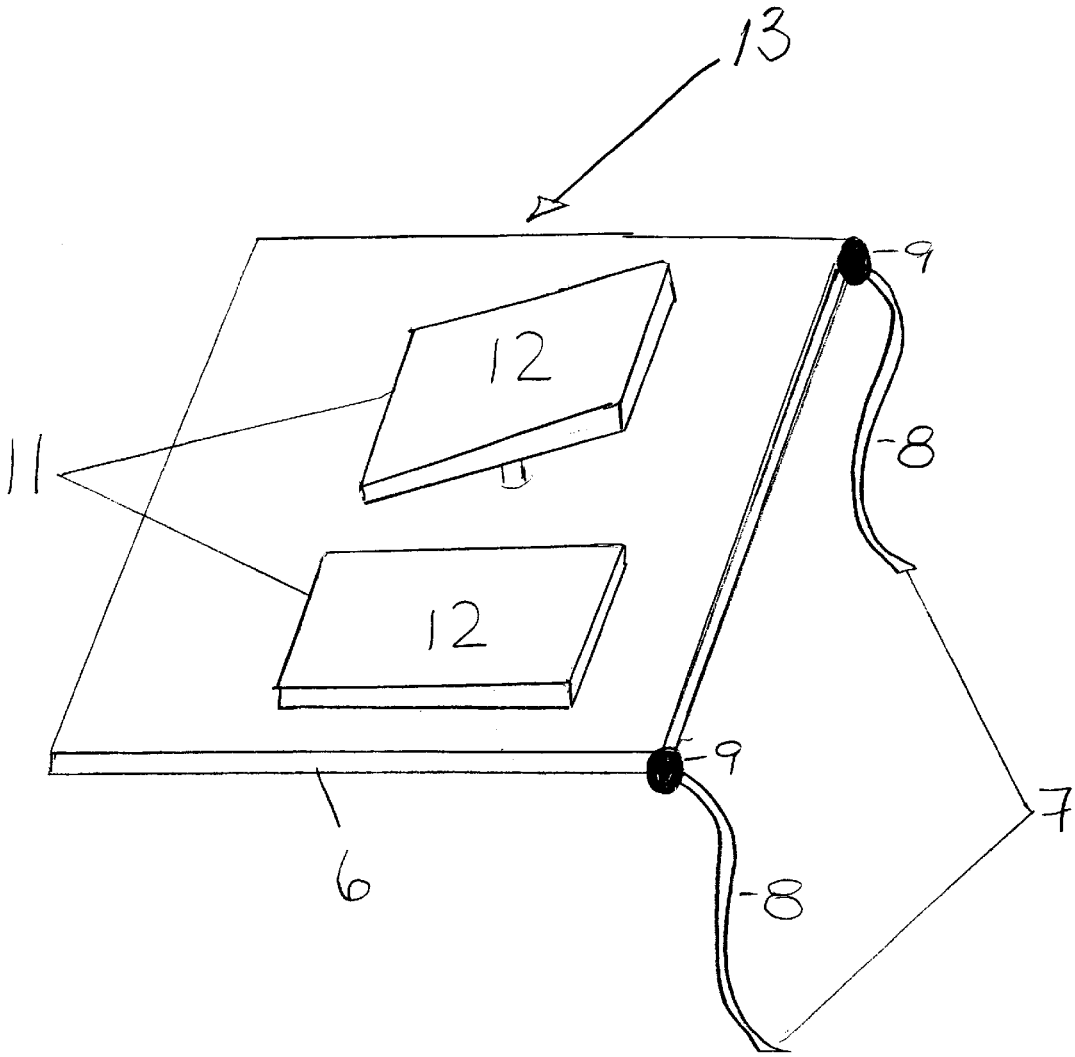
FIG. 3 is a perspective view of a second embodiment of an exercise device in accordance with the present invention.
Figure 4:
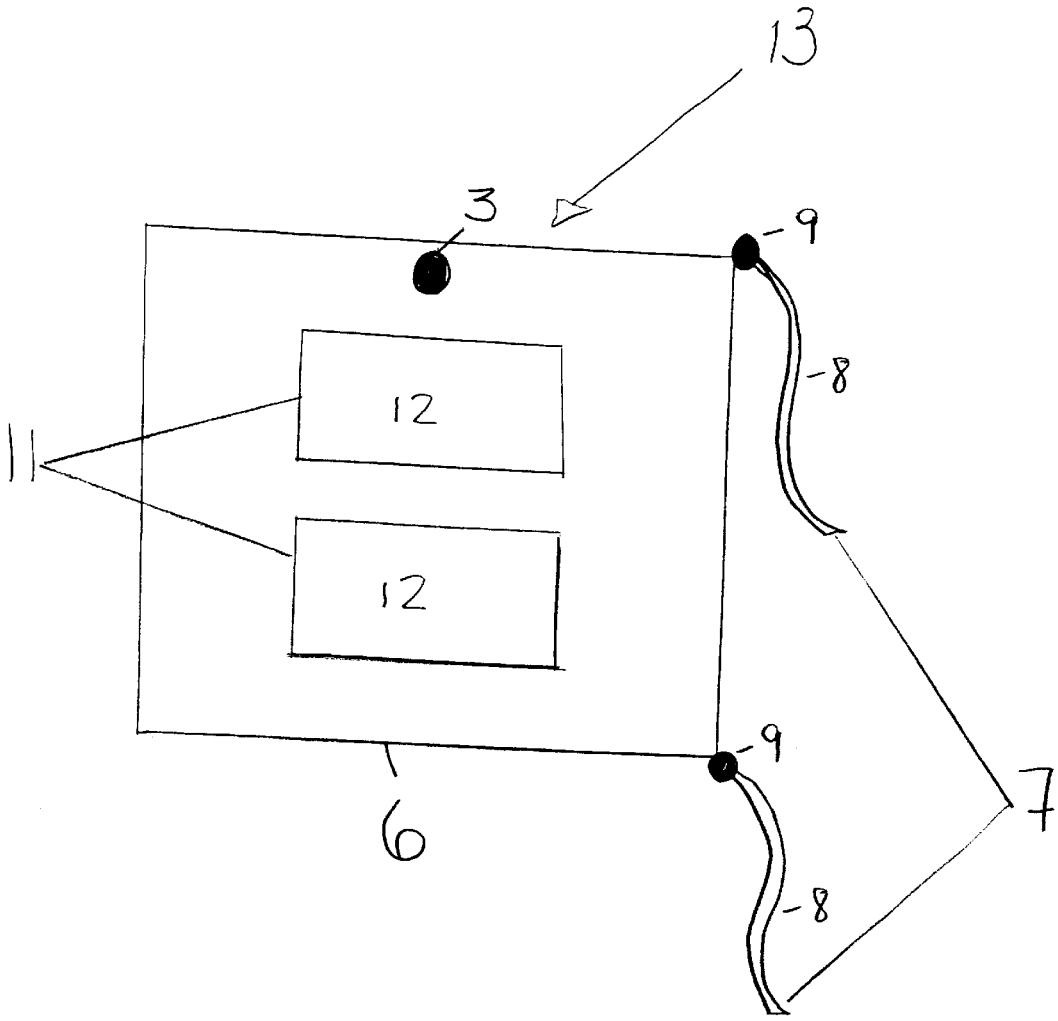
FIG. 4 is a top view of the exercise device of FIG. 3.

A second embodiment of an exercise device 13 that may be used while the user is seated at a desk or other working surface is illustrated in FIGS. 3 and 4. Referring to FIG. 3, the exercise element of the present invention is a stepping element 11 having two steps 12 similar to a stair master. In a preferred embodiment, the steps 12 are about 1 foot high. The stepping element 11 is attached to the mounting element 6 in any manner suitable to achieve functionality, i.e. so that the user may exert force on the steps in an alternating fashion similar to a stair master. Referring to FIG. 4, the stepping element 11 may be operationally linked to a resistance adjustment 3. More than one resistance adjustment may be used in accordance with the present invention. For example, each step of the stepping element may be operationally linked to a separate resistance adjustment element such that the user may adjust the force required for only one leg.

The height of the exercise device of the present invention should be low enough so that the device will fit under a desk. In addition, the height of the exercise element should be low enough that the user's knees will not hit the top of the desk while the user is exercising.

Other modifications of the exercise device of the present invention are also contemplated. For example, the exercise element may be similar to a leg press and may be used in place of the pedal element and stepping element. The device may be made from any suitable materials include, but not limited to, plastics, rubbers, metals, woods, etc. The device may include straps for strapping the exercise element to the foot of the user in order to ensure that the user's foot does not slip off the exercise device while exercising. In addition, the exercise element may be itself removable and/or movable to make room for the user's legs under the desk when the device is not in use.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description.

What is claimed is:

1. An exercise device comprising:

a) a mounting element;

b) an exercise element mounted to the mounting element; and c) a retractable securing element affixed to the mounting element, wherein the retractable securing element secures the device to a chair, wherein the retractable securing element comprises two retractor elements having retractable velcro straps.

2. An exercise device comprising:

a) a mounting element;

b) an attachment element mounted to the mounting element;

c) a pedal element attached to the attachment element; and d) a retractable securing element affixed to the mounting element, wherein the retractable securing element secures the device to a chair, wherein the retractable securing element comprises two retractor elements having retractable velcro straps.

3. The exercise device of claim 2 further comprising a resistance adjustment element operationally linked to the pedal element.

4. The exercise device of claim 2 further comprising a height adjustment element for adjusting the height of the pedal element.

* * * * *